US007080949B1

(12) United States Patent
Yamamoto

(10) Patent No.: US 7,080,949 B1
(45) Date of Patent: Jul. 25, 2006

(54) COMPOSITE WRITING UTENSIL

(75) Inventor: Tadashi Yamamoto, Sakado (JP)

(73) Assignee: Kotobuki & Co., Ltd., Kawagoe (JP)

( * ) Notice: Subject to any disclaimer, the term of this patent is extended or adjusted under 35 U.S.C. 154(b) by 0 days.

(21) Appl. No.: 11/128,378

(22) Filed: May 13, 2005

(51) Int. Cl.
*B43K 27/00* (2006.01)

(52) U.S. Cl. ..... 401/33; 401/32; 401/30

(58) Field of Classification Search ..... 401/29–33
See application file for complete search history.

(56) References Cited

U.S. PATENT DOCUMENTS

| | | | | |
|---|---|---|---|---|
| 4,283,151 | A * | 8/1981 | Sekiguchi | 401/33 |
| 5,749,663 | A * | 5/1998 | Takahashi | 401/31 |
| 5,909,975 | A * | 6/1999 | Kobayashi | 401/30 |
| 6,315,477 | B1 * | 11/2001 | Kuhn et al. | 401/32 |

FOREIGN PATENT DOCUMENTS

JP 11-314491 11/1999

* cited by examiner

*Primary Examiner*—David J. Walczak
(74) *Attorney, Agent, or Firm*—McGinn IP Law Group, PLLC

(57) ABSTRACT

A composite writing utensil for housing a plurality of writing members, at least one of which is a propelling pencil writing member, comprises a front shaft, a rear shaft which is rotatable relative to the front shaft, and a guide shaft for guiding the writing member in the back-and-forth direction. An annular engaging stepped portion projecting in the direction of inner diameter is formed on an inner peripheral surface of the rear shaft, and a plurality of engaging pieces formed at the rear end portion of the guide shaft to pass through an inner diameter-side hollow portion defined by the annular engaging stepped portion of the rear shaft and to be engaged with the engaging stepped portion of the rear shaft. A lead guiding member rotatable relative to the rear shaft is disposed between the plurality of the engaging pieces. The lead guiding member includes a lead guiding portion which further extends forward and communicates to an aperture at the rear end of the lead case of the propelling pencil writing member, and is formed with a plurality of concave portions on its peripheral surface to be fitted with the plurality of the engaging pieces.

8 Claims, 7 Drawing Sheets

COMPOSITE WRITING UTENSIL

BACKGROUND OF THE INVENTION

1. Field of the Invention

The present invention relates to a composite writing utensil in which a plurality of writing members, at least one of which is a propelling pencil writing member, are housed within a shaft barrel, capable of selectively projecting the tip of a desired one of the writing members from the tip of a front shaft so as to be maintained in a writing position, and more particularly to a composite writing utensil improved in refilling the propelling pencil writing member with lead.

2. Description of the Related Art

In the composite writing utensil, when refilling the propelling pencil writing member with a lead, it has been conventionally proposed to render a lead capable of being inserted from the rear end of the shaft barrel, as in the case with an ordinary, single writing utensil which is not a composite writing utensil, for facilitating a refilling operation of a lead (see, for example, Japanese Patent Laid-Open No. 11-314491 or U.S. Pat. No. 6,315,477).

In, for example, the composite writing utensil disclosed in Japanese Patent Laid-Open No. 11-314491, a sliding piece fixed to the rear end of a lead case pipe of the propelling pencil writing member is provided with a cam oblique surface on a rear side thereof for contacting a cam inclined surface of a cylinder cam and is provided with a lead penetrating hole for communicating with the lead case pipe of the propelling pencil writing member. The cylinder cam is also provided with another substantially similar cam inclined surface inside of the cam inclined surface to which the sliding piece always opposes with a minimum clearance. Also the cylinder cam is provided with a lead penetrating hole for aligning with the lead penetrating hole of the sliding piece when the sliding piece is in the most retracted position. A lead fastening device for allowing the lead penetrating hole of the cylinder cam to an opened state or a blockaded state is mounted onto the cylinder cam. When refilling with lead, the propelling pencil writing member is placed at the most retracted position and the lead fastening device is drawn backward so as to set the lead penetrating hole of the cylinder cam to the opened state, a lead is inserted through the lead penetrating hole in the opened state.

In the composite writing utensil disclosed in U.S. Pat. No. 6,315,477, a tip of a cylindrical tube is telescopically disposed into a rear end of a lead case pipe of a propelling pencil writing member, and the rear end of the cylindrical tube extends as far as near the rear end of the housing. Thus, when refilling with lead, a cap on the rear part of the housing is removed to insert lead through the rear end of the cylindrical tube.

In the writing member described in the former publication, however, a problem is that lead cannot be refilled unless the propelling pencil writing member is placed at the most retracted position in order that the lead penetrating hole of the sliding piece coincides with that of the cylinder cam. In contrast to this, in the writing member described in the latter publication, it is possible to refill with lead regardless of the position of the propelling pencil writing member.

In order to smoothly move a plurality of writing members to and fro within the shaft barrel, a guide shaft which rotates together with the front shaft for guiding the sliding piece (or slider) in the back-and-forth direction is desirably provided within the rear shaft. In the case that the guide shaft is provided, structure and space for mounting the guide shaft within the rear end portion of the rear shaft are required. A problem is that it becomes difficult to set a lead penetrating path leading to the propelling pencil writing member. In the structure described in the above patent publications, since no guide shaft has been provided in the structure, the space formed in the rear end part of the rear shaft can be utilized as a lead penetrating path comparatively freely. However, there are no disclosure concerning structure in which the guide shaft can be securely mounted to the rear shaft and lead can be refilled at whichever position i.e. either one of in the most retracted position, the most advanced position and any intermediate position between them, the propelling pencil writing member may be located in the prior publications.

SUMMARY OF THE INVENTION

In view of the foregoing and other drawbacks, disadvantages and problems of the conventional structure, an object of the present invention is to provide a composite writing utensil capable of ensuring a lead penetrating path even if a guide shaft may be provided, and refilling a propelling pencil writing member with a lead from behind at whichever position between the most retracted position and the most advanced position the propelling pencil writing member may be located.

In order to achieve the above-stated object, a composite writing utensil according to the present invention for housing a plurality of writing members, at least one of which is a propelling pencil writing member, comprises a front shaft and a rear shaft which is rotatable relative to the front shaft and includes a cam portion. The cam portion allows a tip of one of the plurality of writing members to selectively project from a tip of the front shaft upon a relative rotation between the front shaft and the rear shaft.

The composite writing utensil further comprises a guide shaft for guiding the writing member in a back-and-forth direction. The guide shaft is unrotatably coupled to the front shaft and extends within the rear shaft. An annular engaging stepped portion projecting in a direction of inner diameter is formed on an inner peripheral surface of the rear shaft. A plurality of engaging pieces are formed at the rear end portion of the guide shaft to pass through an inner diameter-side hollow portion defined by the annular engaging stepped portion of the rear shaft and to be engaged with the engaging stepped portion of the rear shaft. A lead guiding member rotatable relative to the rear shaft is disposed between the plurality of the engaging pieces. The lead guiding member includes a lead guiding portion which further extends forward and communicates to an aperture at the rear end of the lead case of the propelling pencil writing member, and is formed with a plurality of concave portions on its peripheral surface to be fitted with the plurality of the engaging pieces. The lead guiding member together with the engaging pieces of the guide shaft pass through the inner diameter-side hollow portion of the annular engaging stepped portion formed on the rear shaft.

The guide shaft can be rotatably mounted to the rear shaft in a secure manner by the engaging pieces thereof being engaged with the engaging stepped portion of the rear shaft. Thus, since the lead guiding member passes through the inner diameter-side hollow portion of the engaging stepped portion of the rear shaft together with the engaging pieces of the guide shaft, it is possible to effectively utilize the narrow space formed by the engaging stepped portion of the rear shaft, and to ensure a lead penetrating path configured by the lead guiding member. Since the lead guiding member is capable of rotating with the guide shaft, at whichever position between the most retracted position and the most advanced position, the propelling pencil writing member may be located, in other words, at whatever position of rotation the propelling pencil writing member may be located relative to the rear shaft, the lead guiding portion of the lead guiding member always communicates to the aperture of the lead case at the rear end on the substantially same line as the lead case of the propelling pencil writing member, and is capable of refilling with lead. Also, since the guide shaft guides the writing member, the writing member is capable of smoothly moving in the back-and-forth direction.

A slider for cooperating with the cam portion can be provided at the rear end of the writing member, and is guided in the back-and-forth direction by the guide shaft. Since the slider is guided by the guide shaft, the writing member is capable of smoothly moving in the back-and-forth direction.

The lead guiding member can include a main body portion disposed between the plurality of engaging pieces and is formed with the concave portion. A lead insertion hole can be formed to penetrate over the main body portion and the lead guiding portion. A lead can be refilled through the lead insertion hole.

The lead insertion hole can be disposed between two adjacent concave portions of the main body portion. With this structure, the narrow space surrounded by the engaging stepped portion of the rear shaft can be effectively utilized without competition/interference between the lead penetrating path constituted by the lead insertion hole and the engaging pieces of the guide shaft to be fitted to the concave portion.

Preferably, the engaging pieces of said guide shaft are prevented from displacing in a direction of inner diameter by said lead guiding member. Since the engaging pieces cannot make any displacement in the direction of inner diameter by the lead guiding member, the engaging pieces are prevented from being released from the engaging stepped portion. Thereby, the guide shaft can be reliably mounted to the outer shaft.

The lead guiding member can form a circular outer contour in cross section together with the engaging pieces of the guide shaft. With this structure, the lead guiding member and the engaging pieces of the guide shaft are capable of smoothly rotating within the inner diameter-side hollow portion of the annular engaging stepped portion.

DETAILED DESCRIPTION OF THE PREFERRED EMBODIMENTS

Hereinafter, with reference to the drawings, the description will be made of an embodiment of the present invention.

Figure 1:
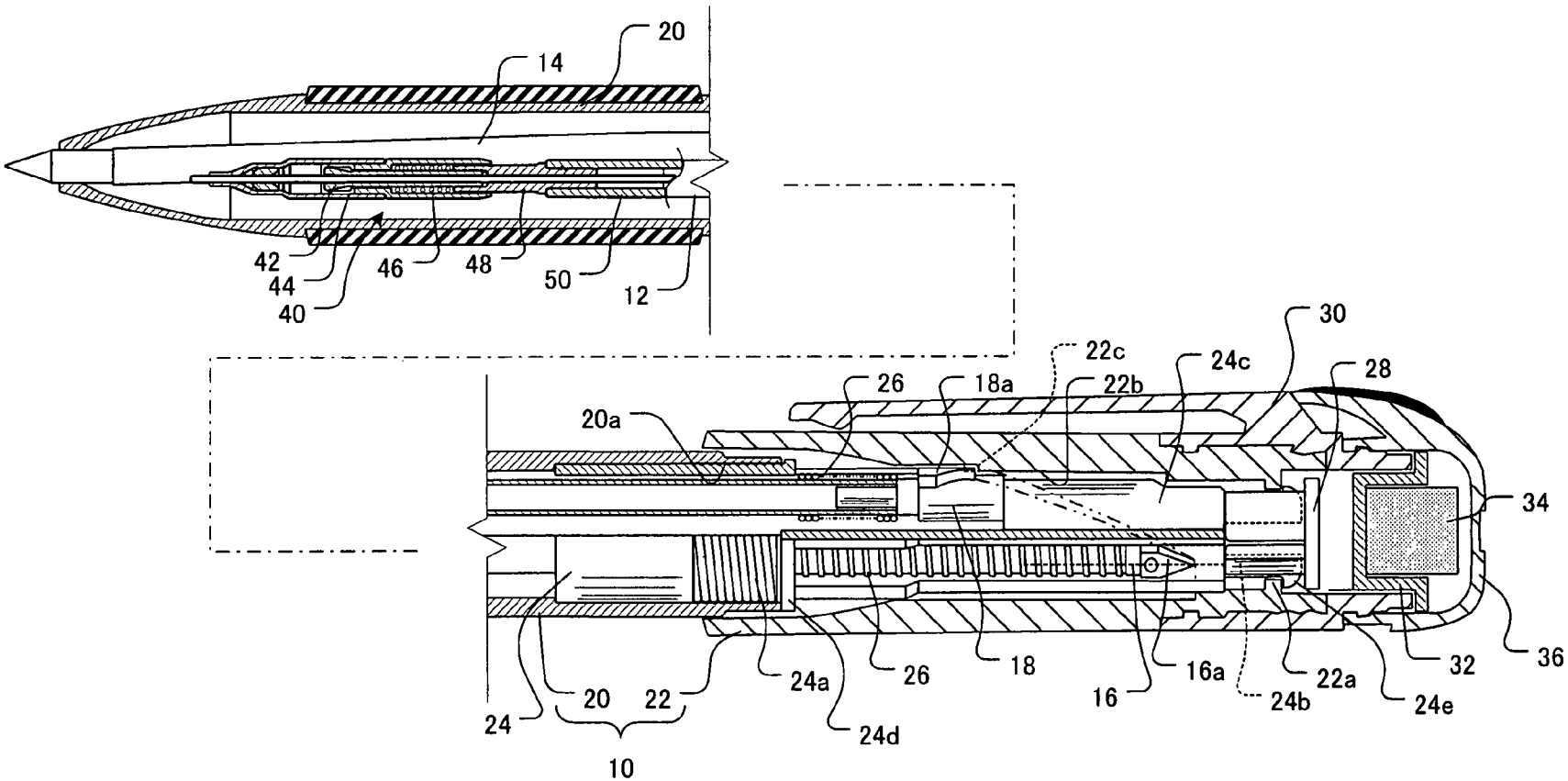
FIG. 1 is an overall longitudinal sectional view showing a composite writing utensil according to an embodiment of the present invention.

FIG. 1 is an overall longitudinal sectional view showing a composite writing utensil according to an embodiment of the present invention. In FIG. 1, within a shaft barrel 10, a plurality of writing members 12, 14, 15 (one of which is not shown because located on this side) are housed, one of which is a propelling pencil writing member 12, and the remaining two of which are ball pen writing members 14, 15. In this respect, two or all of them may be propelling pencil writing members. Also, a number of writing members to be housed within the shaft barrel 10 is not limited to three, but may be two or more.

The shaft barrel 10 includes a front shaft 20 and a rear shaft 22 which is relatively rotatable to the front shaft 20. The front shaft 20 and the rear shaft 22 are detachably coupled to each other via a guide shaft 24. More specifically, a female threaded portion 20*a* is formed on the inner peripheral surface of the rear end portion of the front shaft 20, and the female threaded portion 20*a* is threadably attached to a male threaded portion 24*a* formed on the outer peripheral surface of the tip portion of the guide shaft 24 detachably. The guide shaft 24 extends within the rear shaft 22, and a plurality of engaging pieces 24*b* formed on the rear end portion thereof are engaged with an annular engaging stepped portion 22*a* formed on the inner peripheral surface of the rear shaft 22, and are mounted relatively rotatably but unremovably to the rear shaft 22.

Figure 2:
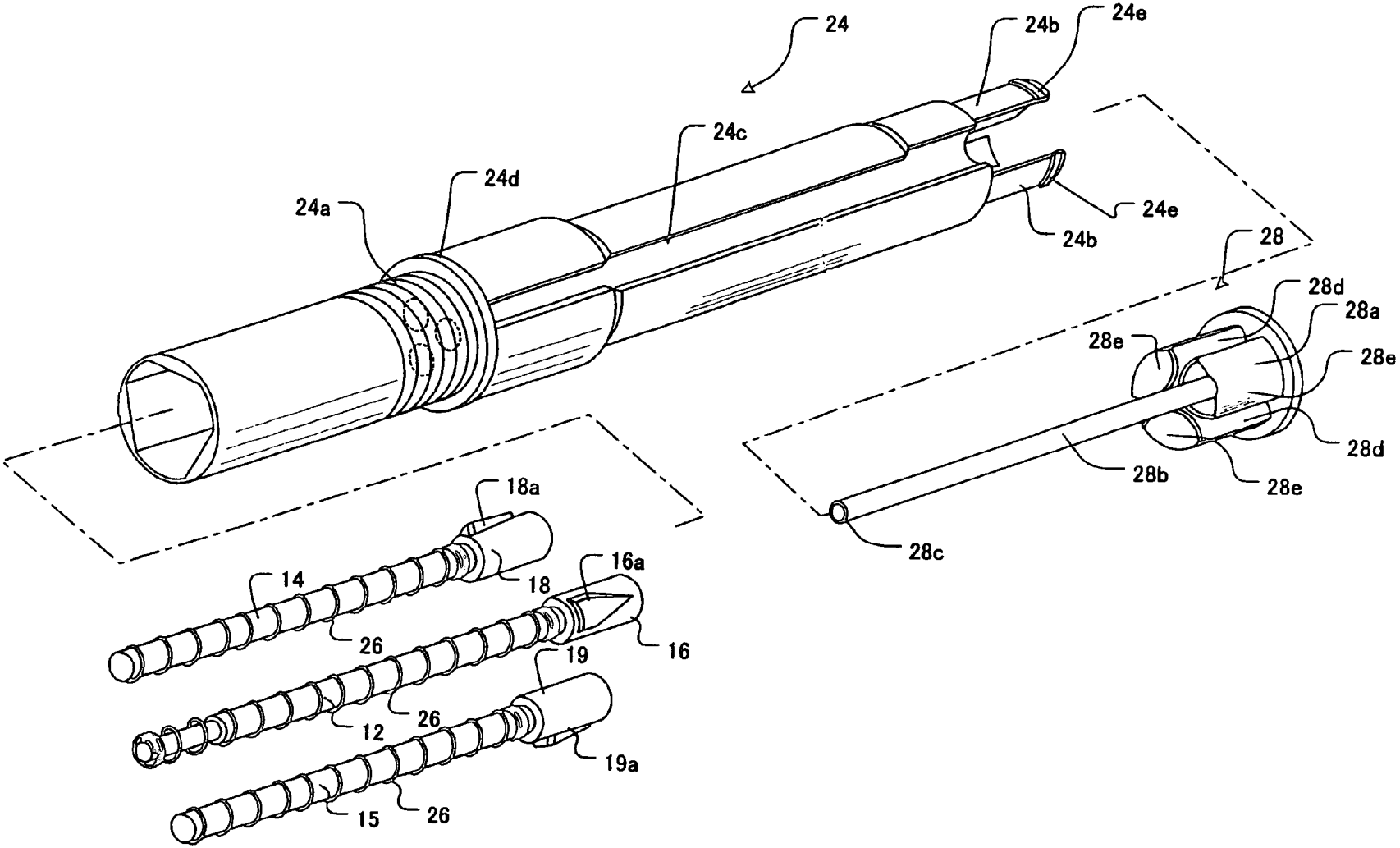
FIG. 2 is an exploded perspective view showing principal parts of the composite writing utensil.

The guide shaft 24 is, as shown in FIG. 2, formed with a plurality of concave sliding grooves 24*c* at an equiangular spacing on the outer peripheral surface thereof, corresponding to a number of the writing members. In the sliding grooves 24*c*, sliders 16, 18, 19 mounted to the rear end of each writing member 12, 14, 15 are adapted to be slidable. Also, a partition portion 24*d* is formed immediately behind the male threaded portion 24*a* of the guide shaft 24, and springs 26 are inserted between the partition portion 24*d* and the sliders 16, 18, 19 to always urge the sliders 16, 18, 19 rearward. The engaging pieces 24*b* further extend toward the rear from the portion of the outer peripheral surface at the rear end portion of the guide shaft 24 on which the sliding grooves 24*c* are not be formed. Further, a hook-shaped projection 24*e* for projecting in the direction of outer diameter is formed at the tip portion of each engaging piece 24*b*. The number of the engaging pieces 24*b* is the same as that of the writing members in this case, but is not limited thereto, but may be different. Rather, in order to restrain the hook-shaped projection 24*e* of the engaging piece 24*b* to the annular engaging stepped portion 22*a* with stability, the number of the engaging pieces 24*b* is desirably three more or less, irrespective of the number of the writing members. The engaging pieces 24*b* pass through an inner diameter-side hollow portion of the annular engaging stepped portion 22*a* formed on the inner peripheral surface of the rear shaft 22, and their hook-shaped projections 24*e* are restrained by the rear end surface of the engaging stepped portion 22*a*. Thus, the guide shaft 24 is mounted relatively rotatably to the rear shaft 22.

On the inner peripheral surface of the rear shaft 22, a cam projection (cam portion) 22*b*, the tip portion of which is in a V-shape projecting forward, is projectingly provided in the direction of inner diameter. A small concave portion 22*c* is formed at the tip portion of the cam projection 22*b*. Small cam projections 16*a*, 18*a*, 19*a* are projectingly provided in the direction of outer diameter on the outer peripheral surface of the slider 16, 18, 19, and the cam projections 16*a*, 18*a*, 19*a* are movable along the V-shaped inclined surface of the cam projection 22*b*, and are engageable with the concave portion 22*c* in the cam portion 22*b*.

Figure 6:
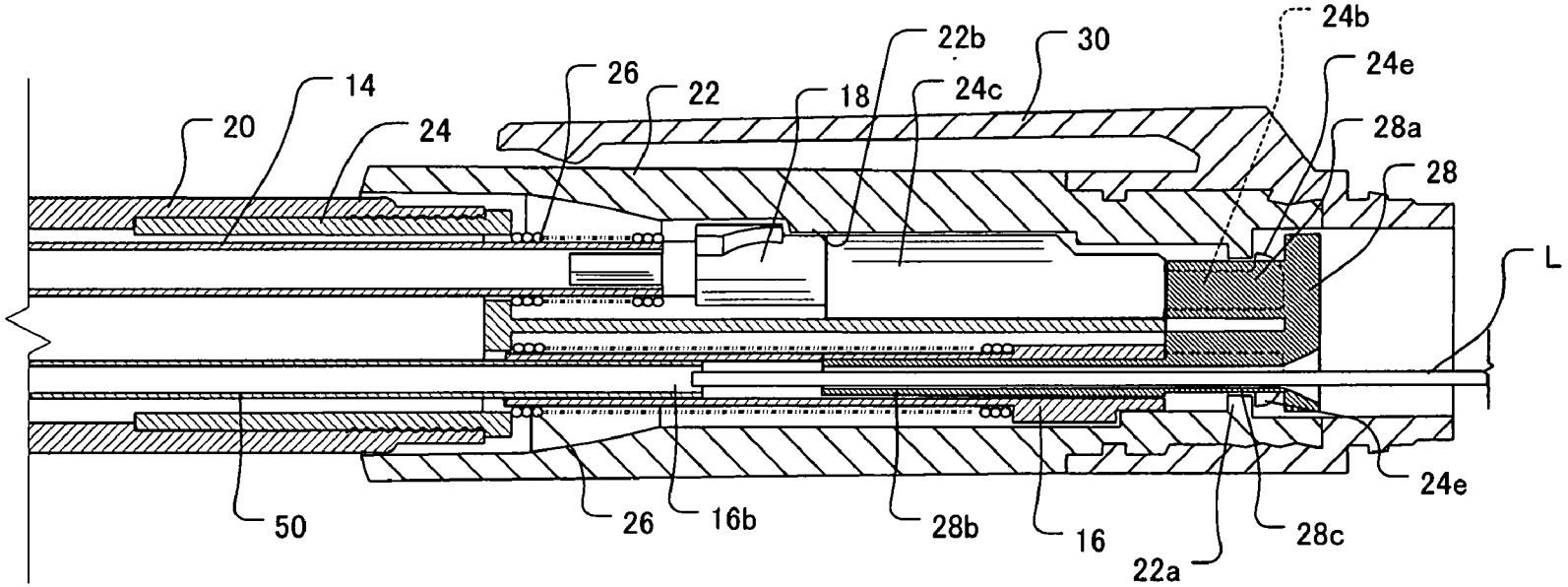
FIG. 6 is a sectional view showing the rear part of the composite writing utensil when refilling with a lead in a state in which a propelling pencil writing member is in a retracted position.

The propelling pencil writing member 12 includes a lead feeding mechanism 40 for moving a lead forwardly at the tip portion thereof, and the lead feeding mechanism 40 includes, as well known, a clamping chuck 42 for clamping and sending out a lead; a chuck ring 44 for further tightening the clamping chuck 42 from the outer periphery side; a chuck spring 46 for biasing the clamping chuck 42 backward, and the like. Further, the propelling pencil writing member 12 has a lead case pipe 50 to which the clamping chuck 42 is coupled directly or via a coupling 48, and spare leads are housed within the pipe hole of the lead case pipe 50. The rear end of the lead case pipe 50 is inserted into the slider 16. As shown in FIG. 6, the slider 16 is formed with the lead penetrating hole 16*b* which communicates to a pipe hole in the lead case pipe 50. Each of ball pen writing members 14, 15 includes a refill containing ink, and the rear end of the refill is inserted into the sliders 18, 19.

Figure 3A:
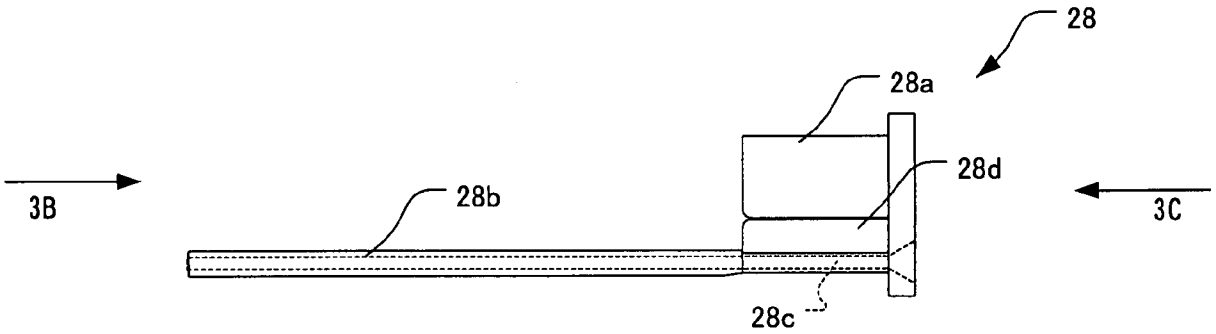
FIG. 3A is a side view showing a lead guiding member.
Figure 3B:
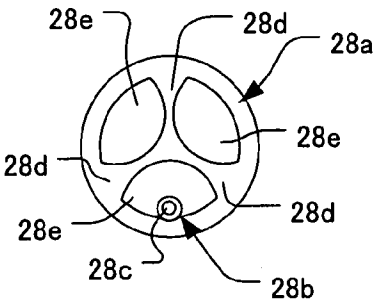
FIG. 3B is an arrow view as viewed in the direction of the line 3B in FIG. 3A.
Figure 3C:
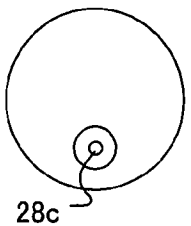
FIG. 3C is an arrow view as viewed in the direction of the line 3C in FIG. 3A.
Figure 4:
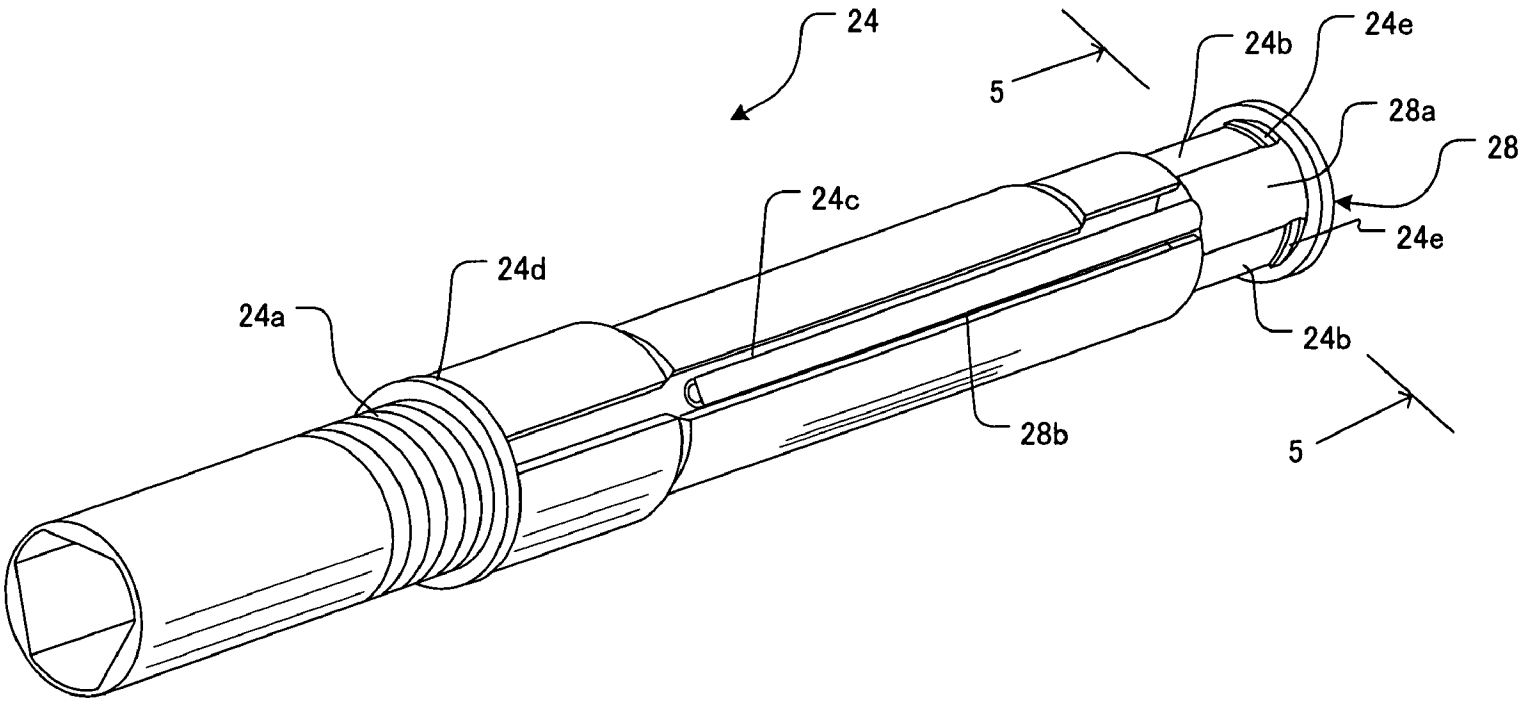
FIG. 4 is a perspective view showing a state in which a guide shaft and the lead guiding member have been combined.
Figure 5:
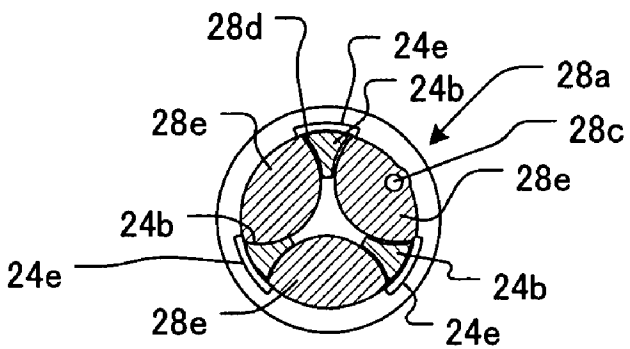
FIG. 5 is a sectional view taken at line 5—5 in FIG. 4.

A lead guiding member 28 is disposed relatively rotatable to the rear shaft 22 inside the rear part of the rear shaft 22. The lead guiding member 28 includes, as shown in FIG. 3, a main body portion 28*a* to be disposed between a plurality of engaging pieces 24*b* of the guide shaft 24, and a pipe-shaped lead guiding portion 28*b* for extending ahead from the main body portion 28*a*, and a lead insertion hole 28*c* through which one lead can pass is formed with penetrating the main body portion 28*a* and the lead guiding portion 28*b*. The main body portion 28*a* has three blocks 28*e*, 28*e*, 28*e*, which can be inserted into the respective three sliding grooves 24*c* of the guide shaft 24, and a clearance formed between the adjacent blocks 28*e* constitutes a concave portion 28*d* formed on the peripheral surface of the main body portion 28*a*. The engaging pieces 24*b* of the guide shaft 24 are fitted to the respective concave portions 28*d*. In a state in which the engaging pieces 24*b* are fitted to the respective concave portion 28*d*, the main body portion 28*a* consisting of three blocks 28*e* and the engaging pieces 24*b* together constitute a circular outer contour except the portions in which the hook-shaped projections 24*e* of the engaging pieces 24*b* are formed, as shown in FIG. 5, and pass through the inner diameter-side hollow portion of the engaging stepped portion 22*a* of the rear shaft 22, and the lead guiding member 28 is rotatable to the rear shaft 22 together with the guide shaft 24. Also, since the lead insertion hole 28*c* is formed in one of the blocks 28*e* interposed between the concave portion 28*d* and the adjacent concave portion 28*d*, as shown in FIG. 5, the lead insertion hole 28*c* is arranged without competition/interference with the engaging pieces 24*b*.

The lead guiding portion 28*b* of the lead guiding member 28 extends within the sliding groove 24*c*, and the tip thereof is to be inserted into the lead penetrating hole 16*b* of the slider 16 from behind. Thereby, the lead insertion hole 28*c* of the lead guiding member 28 communicates to the pipe hole in the lead case pipe 50 via the slider 16.

A clip cap 30 is coupled by press fitting to the rear end portion of the rear shaft 22, and further, in the clip cap 30 or at the rear end portion of the rear shaft 22, an eraser receiver 32 with eraser 34 and a knock cap 36 are detachably attached.

In the composite writing utensil to be constructed as described above, when the rear shaft 22 is rotated relative to the front shaft 20, relative rotation occurs between the rear shaft 22 and the guide shaft 24, thus the slider 16, 18, 19 fitted to the guide groove 24*c* of the guide shaft 24 rotate relative to the rear shaft 22. The cam projections 16*a*, 18*a*, 19*a* of the sliders 16, 18, 19 then move along the inclined surface of the cam projection 22*b* of the rear shaft 22, and one of the sliders engages with the concave portion 22*c* at the tip of the cam projection 22*b*. Thus, the tip of the writing member coupled to the slider projects from the tip of the front shaft 20 so as to be maintained in the writing position. Also, the cam projections of any other sliders than it are located in a rearward position from the concave portion 22*c* of the cam projection 22*b*, and the writing members coupled to those sliders are maintained in a retracted position in which the tip of the writing member is rearward from the tip of the front shaft 20. When the rear shaft 22 is further rotated relative to the front shaft 20, the writing member to be maintained in the writing position is switched, or all the writing members can be also maintained in the retracted position. In the above-described operation, the lead guiding member 28 also rotates together with a rotation of the guide shaft 24.

Figure 7:
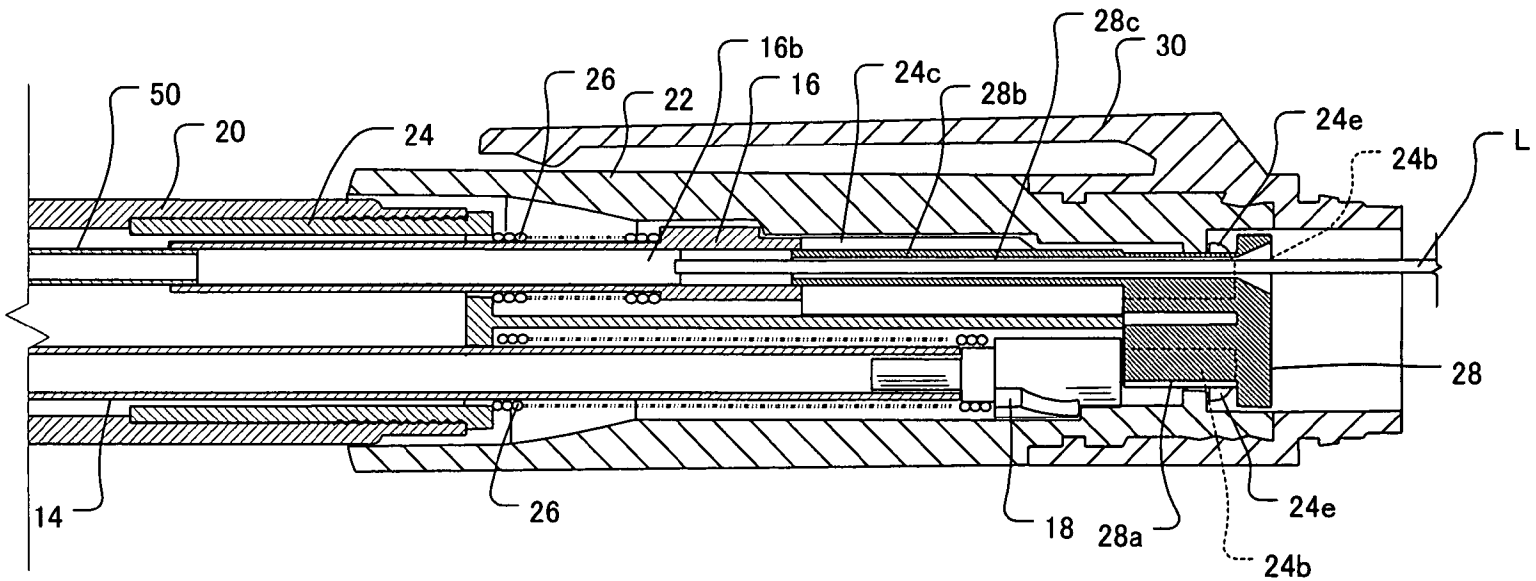
FIG. 7 is a sectional view showing the rear part of the composite writing utensil when refilling with a lead in a state in which the propelling pencil writing member is in a writing position.

When refilling a propelling pencil writing member 12 with lead, the knock cap 36 and the eraser receiver 32 are removed from the clip cap 30 or the rear shaft 22 as shown in FIG. 6 or FIG. 7. Then, the rear end surface of the lead guiding member 28 is exposed and it becomes possible to insert a lead L from the lead insertion hole 28*c*. The lead L inserted through the lead insertion hole 28*c* passes through the lead penetrating hole 16*b* of the slider 16, and moves into the pipe hole of the lead case pipe 50. Thus, the lead can be refilled from behind the composite writing utensil as in the case with the procedure of a single writing utensil. The lead guiding member 28 always rotates integrally with the guide shaft 24, whereby the lead guiding portion 28*b* of the lead guiding member 28 always hold the relationship in which it communicates to the lead penetrating hole 16*b* of the slider 16 and the pipe hole of the lead case pipe 50, and therefore, even if the propelling pencil writing member 12 may be in a retracted position (FIG. 6), or even if in a writing position (FIG. 7) it is possible to refill with a lead at any position.

When a lead refilled to the propelling pencil writing member 12 is desired to be used, knocking the knock cap 36 causes the rear shaft 22 to advance toward the front shaft 20 in a state in which the propelling pencil writing member 12 is in a writing position, and the knocking force is transmitted to the slider 16 from the cam projection 22*b* to advance the lead case pipe 50. Thereby, a lead can be moved forward by the operation of the lead feeding mechanism 40.

According to the present invention, since the main body portion 28*a* of the lead guiding member 28 forms a circular outer contour together with the engaging pieces 24*b* of the guide shaft 24 and passes through the inner diameter-side hollow portion of the engaging stepped portion 22*a*, the narrow space within the engaging stepped portion 22*a* is effectively utilized. Thus, since the lead insertion hole 28*c* is formed in one of blocks 28*e* disposed between concave portions 28*d* and 28*d* which are adjacent to each other, the lead insertion hole 28*c* does not interfere with the engaging piece 24*b*, but the narrow space is adapted to be able to be effectively utilized.

Also, since the engaging piece 24*b* is fitted to the concave portion 28*d* of the main body portion 28*a* of the lead guiding member 28, the engaging piece 24*b* is unable to make a displacement in a direction of inner diameter, and therefore, there is no possibility that the hook-shaped projection 24*e* of the engaging piece 24*b* is released from the engaging stepped portion 22*a* of the rear shaft 22.

When assembling the guide shaft 24 to the rear shaft 22, the guide shaft 24 is inserted from ahead of the rear shaft 22, the engaging pieces 24*b* displace in the direction of inner diameter, and after the hook-shaped projections 24*e* pass through the inner diameter-side hollow portion of the engaging stepped portion 22*a* of the rear shaft 22, the hook-shaped projection 24*e* is restrained by the engaging stepped portion 22*a* due to an elastic force of the engaging piece 24*b*. Thereafter, the lead guiding member 28 is inserted from behind the rear shaft 22, and the main body portion 28*a* is arranged between the plurality of engaging pieces 24*b*. Therefore, from then on, since the engaging pieces 24*b* are unable to make a displacement in the direction of inner diameter by the main body portion 28*a*, it is possible to prevent the guide shaft 24 from coming off from the rear shaft 22.

As described above, according to the present invention, the engaging pieces of the guide shaft are engaged by the engaging stepped portion of the rear shaft, whereby the guide shaft can be reliably mounted to the rear shaft so as to be rotatable to the rear shaft, and further since the lead guiding member passes through the inner-diameter-side hollow portion of the engaging stepped portion of the rear shaft together with the engaging pieces of the guide shaft, it is possible to effectively utilize the narrow space surrounded by the engaging stepped portion of the rear shaft, and to ensure a lead penetrating path constituted by a lead penetrating hole formed in the lead guiding member. Since the lead guiding member is capable of rotating together with the guide shaft, at whichever position the propelling pencil writing member may be located between the most retracted position and the most advanced position, in other words, at whatever position of rotation the propelling pencil writing member may be located relative to the rear shaft, the lead guiding portion of the lead guiding member always communicates to the aperture of the lead case at the rear end on the substantially same line as the lead case of the propelling pencil writing member, and is capable of refilling with lead.

What is claimed is:

1. A composite writing utensil for housing a plurality of writing members, at least one of which is a propelling pencil writing member, comprising:

a front shaft;

a rear shaft which is rotatable relative to the front shaft and includes a cam portion, said cam portion allowing a tip of one of the plurality of writing members to selectively project from a tip of the front shaft upon a relative rotation between the front shaft and rear shaft;

a guide shaft for guiding the writing member in a back-and-forth direction, said guide shaft being unrotatably coupled to the front shaft and extends within the rear shaft;

an annular engaging stepped portion projecting in a direction of inner diameter formed on an inner peripheral surface of the rear shaft;

a plurality of engaging pieces formed at the rear end portion of the guide shaft to pass through an inner diameter-side hollow portion defined by the annular engaging stepped portion of the rear shaft and to be engaged with the engaging stepped portion of the rear shaft; and a lead guiding member rotatable relative to the rear shaft disposed between the plurality of the engaging pieces, said lead guiding member including a lead guiding portion which further extends forward and communicates to an aperture at a rear end of a lead case of the propelling pencil writing member, and a plurality of concave portions on its peripheral surface to be fitted with the plurality of the engaging pieces;

wherein the lead guiding member together with the engaging pieces of the guide shaft pass through the inner diameter-side hollow portion of the annular engaging stepped portion formed on the rear shaft.

2. The composite writing utensil according to claim 1, wherein a slider for cooperating with the cam portion is provided at the rear end of the writing member, and is guided in the back-and-forth direction by the guide shaft.

3. The composite writing utensil according to claim 2, wherein said lead guiding member includes a main body portion disposed between the plurality of engaging pieces and is formed with the concave portion, and a lead insertion hole is formed to penetrate over said main body portion said the lead guiding portion.

4. The composite writing utensil according to claim 3, wherein said lead penetrating hole is disposed between two adjacent concave portions of said main body portion.

5. The composite writing utensil according to claim 1, wherein said lead guiding member includes a main body portion disposed between the plurality of engaging pieces and is formed with the concave portion, and a lead insertion hole is formed to penetrate over said main body portion said the lead guiding portion.

6. The composite writing utensil according to claim 5, wherein said lead penetrating hole is disposed between two adjacent concave portions of said main body portion.

7. The composite writing utensil according to claim 1, wherein the engaging pieces of said guide shaft are prevented from displacing in a direction of inner diameter by said lead guiding member.

8. The composite writing utensil according to claim 1, wherein said lead guiding member together with the engaging pieces of the guide shaft form a circular outer contour in cross section.

* * * * *